US009574408B2

(12) United States Patent
Cochran et al.

(10) Patent No.: US 9,574,408 B2
(45) Date of Patent: Feb. 21, 2017

(54) WELLBORE STRINGS CONTAINING EXPANSION TOOLS

(71) Applicants: Travis E. Cochran, Houston, TX (US); Aaron C. Hammer, Houston, TX (US); Jason A. Allen, Houston, TX (US); Robert S. O'Brien, Katy, TX (US); Jai K. Koli, Houston, TX (US)

(72) Inventors: Travis E. Cochran, Houston, TX (US); Aaron C. Hammer, Houston, TX (US); Jason A. Allen, Houston, TX (US); Robert S. O'Brien, Katy, TX (US); Jai K. Koli, Houston, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 372 days.

(21) Appl. No.: 14/201,394

(22) Filed: Mar. 7, 2014

(65) Prior Publication Data

US 2015/0252628 A1 Sep. 10, 2015

(51) Int. Cl.
*E21B 17/07* (2006.01)
*E21B 17/00* (2006.01)

(52) U.S. Cl.
CPC ..... *E21B 17/07* (2013.01); *E21B 17/00* (2013.01)

(58) Field of Classification Search
CPC ..... E21B 17/07; E21B 17/06; E21B 23/02; E21B 23/06
See application file for complete search history.

(56) References Cited

U.S. PATENT DOCUMENTS

| | | | |
|---|---|---|---|
| 80,875 A | 8/1868 | Platt et al. | |
| 85,428 A | 12/1868 | Burditt et al. | |
| 1,342,813 A | 6/1920 | Huston | |

(Continued)

FOREIGN PATENT DOCUMENTS

| | | | |
|---|---|---|---|
| EP | 1001132 A2 * | 5/2000 | ..... E21B 17/06 |
| WO | 0026501 A1 | 5/2000 | |

(Continued)

OTHER PUBLICATIONS

PCT International Search Report and Written Opinion; International Application No. PCT/US2015/017515; International Filing Date: Feb. 25, 2015; Date of Mailing: Jun. 8, 2015; 16 Pages.

(Continued)

*Primary Examiner* — Jennifer H Gay
(74) *Attorney, Agent, or Firm* — Cantor Colburn LLP

(57) ABSTRACT

An apparatus for use in a wellbore is disclosed. The apparatus includes a string for deployment into the wellbore, the string including at least one packer and an expansion tool downhole of the packer. The expansion tool further includes: a release device and a lock device inside a movable housing; wherein the lock device prevents shifting of the release device until the lock device is moved to an unlock position by application of a first force to the lock device. The release device is movable to a release position by application of a second force after the lock device has been moved to the unlock position. The movable housing is capable of moving over the release device after the release device has been moved to the release position to absorb at least one of contraction and expansion of the expansion tool.

17 Claims, 10 Drawing Sheets

(56) References Cited

U.S. PATENT DOCUMENTS 3,025,914 A 3/1962 Fether
3,133,595 A 5/1964 Loughney et al.
3,504,936 A * 4/1970 Brown ..... E21B 17/07 175/321
3,726,546 A * 4/1973 Brown ..... E21B 17/07 285/330
4,125,129 A 11/1978 Baumann
4,176,717 A 12/1979 Hix
4,281,858 A * 8/1981 Bowyer ..... E21B 17/06 285/3
4,423,889 A * 1/1984 Weise ..... E21B 17/07 285/302
4,778,008 A * 10/1988 Gonzalez ..... E21B 17/07 166/242.6
5,341,880 A 8/1994 Thorstensen
5,823,264 A * 10/1998 Ringgenberg ..... E21B 17/07 166/355
6,003,607 A * 12/1999 Hagen ..... E21B 17/07 166/120
6,367,552 B1 * 4/2002 Scott ..... E21B 23/02 166/242.7
6,447,021 B1 * 9/2002 Haynes ..... E21B 17/06 166/217
6,978,840 B2 12/2005 Henderson
7,055,598 B2 6/2006 Ross et al.
7,086,479 B2 * 8/2006 Schultz ..... E21B 43/103 166/206
7,578,343 B2 8/2009 Augustine
7,673,678 B2 3/2010 MacDougall et al.
8,061,430 B2 * 11/2011 Du ..... E21B 17/023 166/207
8,220,555 B1 7/2012 Wintill et al.
8,286,701 B2 * 10/2012 Schultz ..... E21B 17/07 166/242.6
8,403,061 B2 3/2013 Russell et al.
8,403,064 B2 3/2013 Allen
8,424,609 B2 4/2013 Duphorne et al.
2002/0092653 A1 7/2002 Scott et al.
2003/0029621 A1 * 2/2003 Haynes ..... E21B 17/06 166/381
2003/0141059 A1 7/2003 Mauldin et al.
2003/0188894 A1 10/2003 Sunde et al.
2005/0039916 A1 2/2005 Schultz et al.
2006/0027377 A1 2/2006 Schoonderbeek et al.
2006/0260818 A1 * 11/2006 Meijer ..... E21B 17/023 166/380
2007/0131434 A1 6/2007 MacDougall et al.
2009/0133874 A1 5/2009 Dale et al.
2010/0163250 A1 * 7/2010 Schultz ..... E21B 17/07 166/381
2010/0224375 A1 * 9/2010 Du ..... E21B 17/023 166/380
2010/0252250 A1 10/2010 Fripp et al.
2011/0048706 A1 3/2011 Clem et al.
2011/0079396 A1 4/2011 Russell et al.
2011/0127047 A1 6/2011 Themig et al.
2011/0146988 A1 6/2011 McGlothen
2011/0186286 A1 8/2011 Allen
2011/0209873 A1 9/2011 Stout
2011/0226481 A1 9/2011 Duphorne et al.
2011/0278017 A1 11/2011 Themig et al.
2012/0085548 A1 4/2012 Fleckenstein et al.
2013/0108356 A1 5/2013 Stautzenberger et al.
2013/0112410 A1 * 5/2013 Szarka ..... E21B 33/16 166/289
2013/0199799 A1 * 8/2013 Phan ..... E21B 17/04 166/380
2014/0166312 A1 * 6/2014 Richards ..... E21B 43/10 166/381
2015/0252628 A1 * 9/2015 Cochran ..... E21B 17/07 166/387
2015/0375144 A1 12/2015 Greci
2016/0069145 A1 * 3/2016 McGuire ..... E21B 34/14 166/308.1
2016/0084018 A1 * 3/2016 Allen ..... E21B 17/07 166/381
2016/0123093 A1 * 5/2016 Richards ..... E21B 17/06 166/381

FOREIGN PATENT DOCUMENTS

WO 2007078375 A2 7/2007
WO 2012162792 12/2012
WO WO2012162792 A1 12/2012

OTHER PUBLICATIONS

PCT International Search Report and Written Opinion; International Application No. PCT/US2014/055889; International Filing Date: Sep. 16, 2014; Date of Mailing: Dec. 23, 2014; pp. 1-10.
PCT International Search Report and Written Opinion; International Application No. PCT/US2014/055886; International Filing Date: Sep. 16, 2014; Date of Mailing: Dec. 19, 2014; pp. 1-9.
PCT International Search Report and Written Opinion; International Application No. PCT/US2014/055887; International Filing Date: Sep. 16, 2014; Date of Mailing: Dec. 18, 2014; pp. 1-10.
PCT International Search Report and Written Opinion, International Application No. PCT/US2014/042081; International Filing Date: Jun. 12, 2014; Date of Mailing: Oct. 6, 2014; pp. 1-14.
PCT International Search Report and Written Opinion; International Application No. PCT/US2015/014607; International Filing Date: Feb. 5, 2015; Date of Mailing: May 19, 2015; pp. 1-10.

* cited by examiner

WELLBORE STRINGS CONTAINING EXPANSION TOOLS

BACKGROUND

1. Field of the Disclosure

This disclosure relates generally to completion strings deployed in wellbores for the production of hydrocarbons from subsurface formations, including completion strings deployed for fracturing, sand packing and flooding, which strings include one or more expansion joints or tools to accommodate for the expansion and contraction of the strings during completion of such wellbores and during the production of hydrocarbons from such wellbores.

2. Background of the Art

Wellbores are drilled in subsurface formations for the production of hydrocarbons (oil and gas). Modern wells can extend to great well depths, often more than 15,000 ft. Hydrocarbons are trapped in various traps or zones in the subsurface formations at different depths. Such zones are referred to as reservoirs or hydrocarbon-bearing formations or production zones. Some reservoirs have high mobility, which is a measure of the ease of the hydrocarbons to flow from such reservoirs into the wells drilled through the reservoirs under natural downhole pressures. Some reservoirs have low mobility and the hydrocarbons trapped therein are unable to move with ease from such reservoirs into the wells drilled therethrough. Stimulation methods are typically employed to improve the mobility of the hydrocarbons through the low mobility reservoirs. One such method, referred to as fracturing (also referred to as "fracing" or "fracking"), is often utilized to create cracks in the reservoir rock to enable the fluid from the reservoir (formation fluid) to flow from the reservoir into the wellbore. To fracture multiple zones, an assembly containing an outer string with an inner string therein is run in or deployed in the wellbore. The outer string typically includes a series of devices corresponding to each zone conveyed by a tubing into the wellbore. The inner string includes devices attached to a tubing to operate certain devices in the outer string and facilitate fracturing and/or other well treatment operations. To fracture and sand pack a zone, a fluid containing a proppant (sand) is supplied under pressure to each zone, sequentially or to more than one zone at the same time. During fracturing operations the fluid supplied from the surface lowers the temperature of the outer string, which can cause the string to contract or shrink. One or more expansion tools or joins are provided in the outer string to accommodate changes in the length of the outer string due to the thermal fluctuations downhole without creating additional stress along the outer string geometry.

The disclosure herein provides a string for placement in a wellbore that may include one or more expansion tools or joints.

SUMMARY

In one aspect, an apparatus for use in a wellbore is disclosed that in one non-limiting embodiment includes a string for deployment into the wellbore, wherein the string includes at least one packer and an expansion device downhole of the packer, and wherein the expansion tool further includes: a release device and a lock device inside a movable housing, wherein the lock device prevents shifting of the release device until the lock device is moved to an unlocked position by application of a first force to the lock device, and wherein the release device is movable to a release position by application of a second force after the lock device has been moved to the unlock position, and wherein the movable housing is capable of moving over the release device after the release device has been moved to the release position to absorb at least one of contraction and expansion of the string.

In another aspect, a method of performing a treatment operation in a wellbore is disclosed that in one non-limiting embodiment includes: placing a string in the wellbore, the string including a packer and an expansion tool downhole of the packer, wherein the expansion device includes a release device held in position by a lock device during run-in of the string into the wellbore; locating the packer at desired location; unlocking the lock device when the expansion tool is in the wellbore; releasing the release device by a tool conveyed from a surface location into the wellbore to cause the expansion tool to attain an expanded position so as to enable the expansion tool to absorb expansion and/or shrinkage of the string during the treatment operation; setting the packer in the wellbore; and performing the treatment operation.

Examples of the more important features of a well treatment system and methods that have been summarized rather broadly in order that the detailed description thereof that follows may be better understood, and in order that the contributions to the art may be appreciated. There are, of course, additional features that will be described hereinafter and which will form the subject of the claims.

BRIEF DESCRIPTION OF THE DRAWINGS

For a detailed understanding of the apparatus and methods disclosed herein, reference should be made to the accompanying drawings and the detailed description thereof, wherein like elements are generally given same numerals and wherein.

DETAILED DESCRIPTION OF THE DRAWINGS

Figure 1:
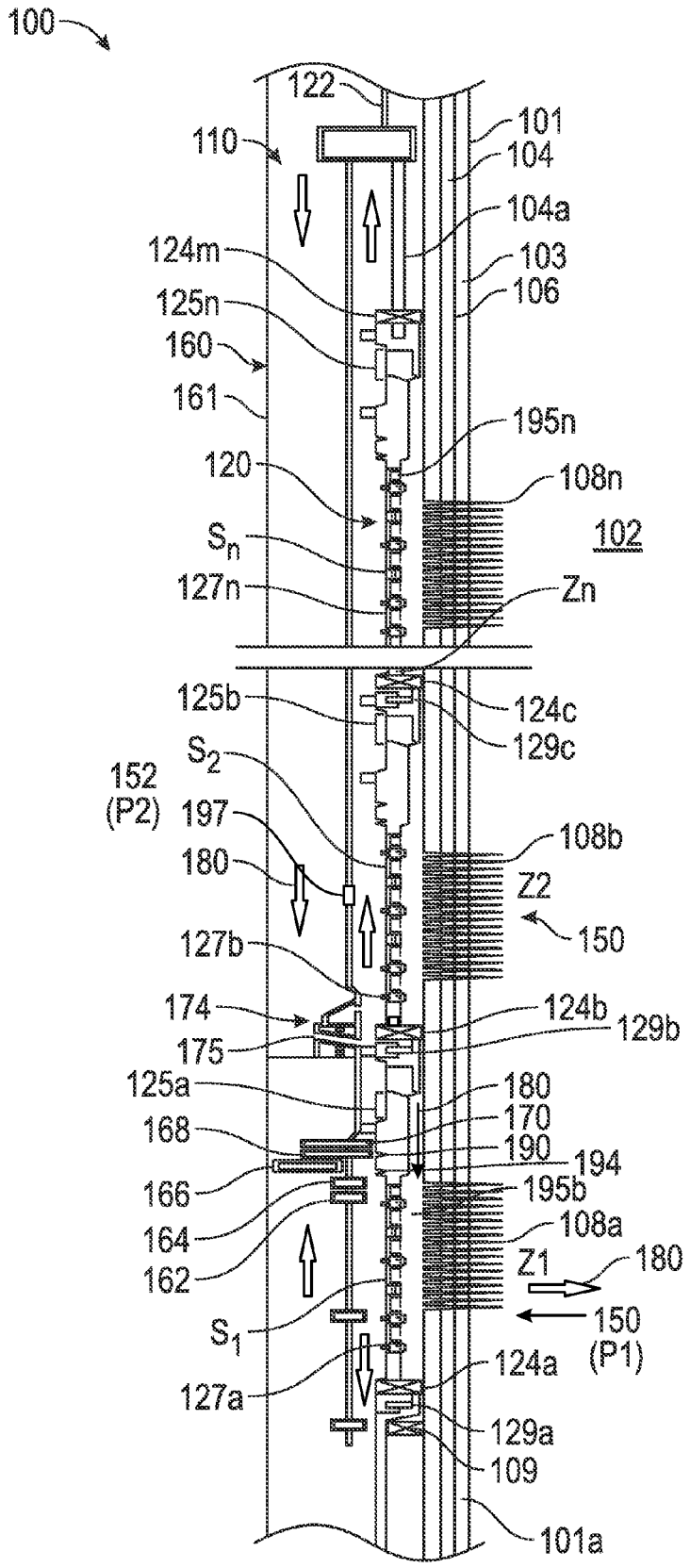
FIG. 1 shows an exemplary cased hole multi-zone wellbore containing a service assembly deployed therein that includes an outer string that includes a service tool section corresponding to each zone and wherein the outer string further includes an expansion tool corresponding to each zone, according to one non-limiting embodiment of the present disclosure.

FIG. 1 is a line diagram of a section of a wellbore system 100 that is shown to include a wellbore 101 formed in formation 102 for performing a treatment operation therein, such as fracturing the formation (also referred to herein as fracing or fracking), gravel packing, flooding, etc. The wellbore 101 is lined with a casing 104, such as a string of jointed metal pipes sections, known in the art. The space or annulus 103 between the casing 104 and the wellbore 101 is filled with cement 106. The particular embodiment of FIG.

1 is shown for selectively fracking and gravel packing one or more zones in any selected or desired sequence or order. However, wellbore 101 may be configured to perform other treatment or service operations, including, but not limited to, gravel packing and flooding a selected zone to move fluid in the zone toward a production well (not shown). The formation 102 is shown to include multiple production zones (or zones) Z1-Zn which may be fractured or treated for the production of hydrocarbons therefrom. Each such zone is shown to include perforations that extend from the casing 104, through cement 106 and to a certain depth in the formation 102. In FIG. 1, Zone Z1 is shown to include perforations 108*a*, Zone Z2 perforations 108*b*, and Zone Zn perforations 108*n*. The perforations in each zone provide fluid passages for fracturing each such zone. The perforations also provide fluid passages for formation fluid 150 to flow from the formation 102 to the inside 104*a* of the casing 104. The wellbore 101 includes a sump packer 109 proximate to the bottom 101*a* of the wellbore 101. The sump packer 109 is typically deployed after installing casing 104 and cementing the wellbore 101. After casing, cementing, sump packer deployment, perforating and cleanup operations, the wellbore 101 is ready for treatment operations, such as fracturing and gravel packing of each of the production zones Z1-Zn. The fluid 150 in the formation 102 is at a formation pressure (P1) and the wellbore 101 is filled with a fluid 152, such as completion fluid, which fluid provides hydrostatic pressure (P2) inside the wellbore 101. The hydrostatic pressure P2 is greater than the formation pressure P1 along the depth of the wellbore 101, which prevents flow of the fluid 150 from the formation 102 into the casing 104 and prevents blow-outs.

Still referring to FIG. 1, to treat (for example fracture) one or more zones Z1-Zn, a system assembly 110 is run inside the casing 104. In one non-limiting embodiment, the system assembly 110 includes an outer string 120 and an inner string 160 placed inside the outer string 120. The outer string 120 includes a pipe 122 and a number of devices associated with each of the zones Z1-Zn for performing treatment operations described in detail below. In one non-limiting embodiment, the outer string 120 includes a lower packer 124*a*, an upper packer 124*m* and intermediate packers 124*b*, 124*c*, etc. The lower packer 124*a* isolates the sump packer 109 from hydraulic pressure exerted in the outer string 120 during fracturing and sand packing of the production zones Z1-Zn. In this case the number of packers in the outer string 120 is one more than the number of zones Z1-Zn. In some cases, the lower packer 109, however, may be utilized as the lower packer 124*a*. In one non-limiting embodiment, the intermediate packers 124*b*, 124*c*, etc. may be configured to be independently deployed in any desired order so as to fracture and pack any of the zones Z1-Zn in any desired order. In another embodiment, some or all of the packers may be configured to be deployed at the same time or substantially at the same time. The packers 124*a*-124*m* may be hydraulically or mechanically set or deployed. The outer string 120 further includes a screen adjacent to each zone. For example, screen S1 is shown placed adjacent to zone Z1, screen S2 adjacent to zone Z2 and screen Sn adjacent to zone Zn. The lower packer 124*a* and intermediate packer 124*b*, when deployed, will isolate zone Z1 from the remaining zones: packers 124*b* and 124*c* will isolate zone Z2 and packers 124*m*−1 and 124*m* will isolate zone Zn. In one non-limiting embodiment, each packer has an associated packer activation device that allows selective deployment of its corresponding packer in any desired order. In FIG. 1, a packer activation/deactivation device 129*a* is associated with the lower packer 124*a*, device 129*b* with intermediate packer 124*b*, device 129*c* with intermediate packer 124*c* and device 129*m* with the upper packer 129*m*.

Still referring to FIG. 1, in one non-limiting embodiment, each of the screens S1-Sn may be made by serially connecting two or more screen sections with interconnecting connection members and fluid flow devices for allowing fluid to flow along the screen sections. The screens also include fluid flow control devices, such as sliding sleeve valves 127*a* (screen S1), 127*b* (screen S2), 127*n* (screen Sn) to provide flow of the fluid 150 from the formation 102 into the outer string 120. The outer string 120 also includes, above each screen a flow control device, referred to as a slurry outlet or a gravel exit, which may be a sliding sleeve valve or another valve, to provide fluid communication between the inside 120*a* of the outer string 120 and each of the zones Z1-Zn. As shown in FIG. 1, a slurry outlet 125*a* is provided for zone Z1 between screen S1 and its intermediate packer 124*b*, slurry outlet 125*b* for zone Z2 and slurry outlet 127*n* for zone Zn. The outer string 120 is run in the wellbore with the slurry outlets (125*a*-125*n*) and flow devices 127*a*-127*n* closed. The slurry outlets and the flow devices can be opened downhole. The outer string 120 also includes a zone indicating profile or locating profile for each zone, such as profile 190 for zone Z1.

Still referring to FIG. 1, the inner string 160 (also referred to herein as the service string) includes a tubular member 161 that in one embodiment carries an opening shifting tool 162 and a closing shifting tool 164. The inner string 160 further may include a reversing valve 166 that enables the removal of treatment fluid from the wellbore after treating each zone, and an up-strain locating tool 168 for locating a location uphole of the set down locations, such as location 194 for zone Z1, when the inner string is pulled uphole, and a set down tool or set down locating tool 170 is set. In one aspect, the set down tool 170 may be configured to locate each zone and then set down the inner string 160 at each such location for performing a treatment operation. The inner string 160 further includes a crossover tool 174 (also referred to herein as the "frac port") for providing a fluid path 175 between the inner string 160 and the outer string 120.

To perform a treatment operation in a particular zone, for example zone Z1, lower packer 124*a* and upper packer 124*m* are set or deployed. Setting the upper packer 124*m* and lower packer 124*a* anchors the outer string 120 inside the casing 104. The production zone Z1 is then isolated from all the other zones. To isolate zone Z1 from the remaining zones Z2-Zn, the inner string 160 is manipulated so as to cause the opening tool 164 to open a monitoring valve 127*a* in screen S1. The inner string 160 is then manipulated (moved up and/or down) inside the outer string 120 so that the set down tool 170 locates the locating or indicating profile 190. The set down tool 170 is then manipulated to cause it to set down inside the string 120. When the set down tool 170 is set, the frac port 174 is adjacent to the slurry outlet 125*a* and thereby isolating or sealing a section that contains the slurry outlet 125*a* and the frac port 174, while providing fluid communication between the inner string 160 and the slurry outlet 125*a*. The packer 124*b* is then set to isolate zone Z1 unless previously set. Once the packer 124*b* has been set, frac sleeve 125*a* is opened, as shown in FIG. 1, to supply slurry or another fluid to zone Z1 to perform a fracturing or a treatment operation as shown by arrows 180. When the outer string 120 and inner string 160 are deployed in the wellbore, the temperature inside the wellbore is close to the formation temperature. During a treatment operation, a fluid or slurry, such as a combination of water and guar along with proppant (typically sand), is supplied from the surface, which fluid is at a surface temperature substantially below the downhole temperature. This lower temperature can cause the outer string to undergo changes in length. Once the treatment operations have been completed, the outer string again may undergo length changes due to higher downhole temperature. The disclosure herein, in one aspect, provides an expansion tool (also referred to herein as the expansion joint) to accommodate for the changes in the outer string length. In one aspect, an expansion tool is placed below certain packers, such as an expansion tool 195*b* below packer 124*b*, expansion tool 195*c* below packer 124*c* and expansion tool 195*m* below packer 124*m*. In some situations, the inner string 160 can become stuck inside the outer string 120 due to excessive amount of sand settling near the frac port which prevents removal of the inner string 60 from the outer string without secondary operations.

Figure 2A:
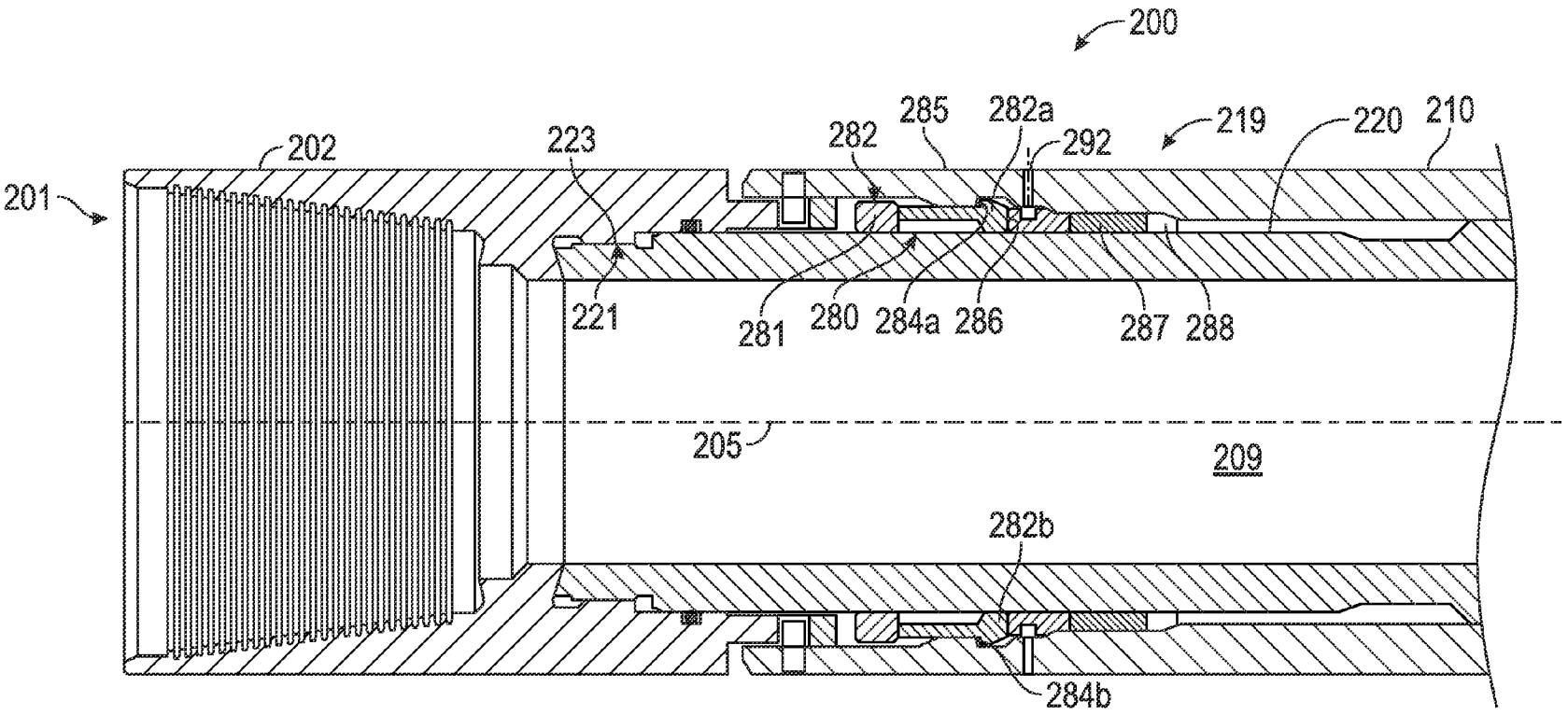
FIG. 2 shows a cross-section of a non-limiting embodiment of an expansion tool in a run-in position that may be utilized in a string in a wellbore, such as the outer string shown in FIG. 1.
Figure 2B:
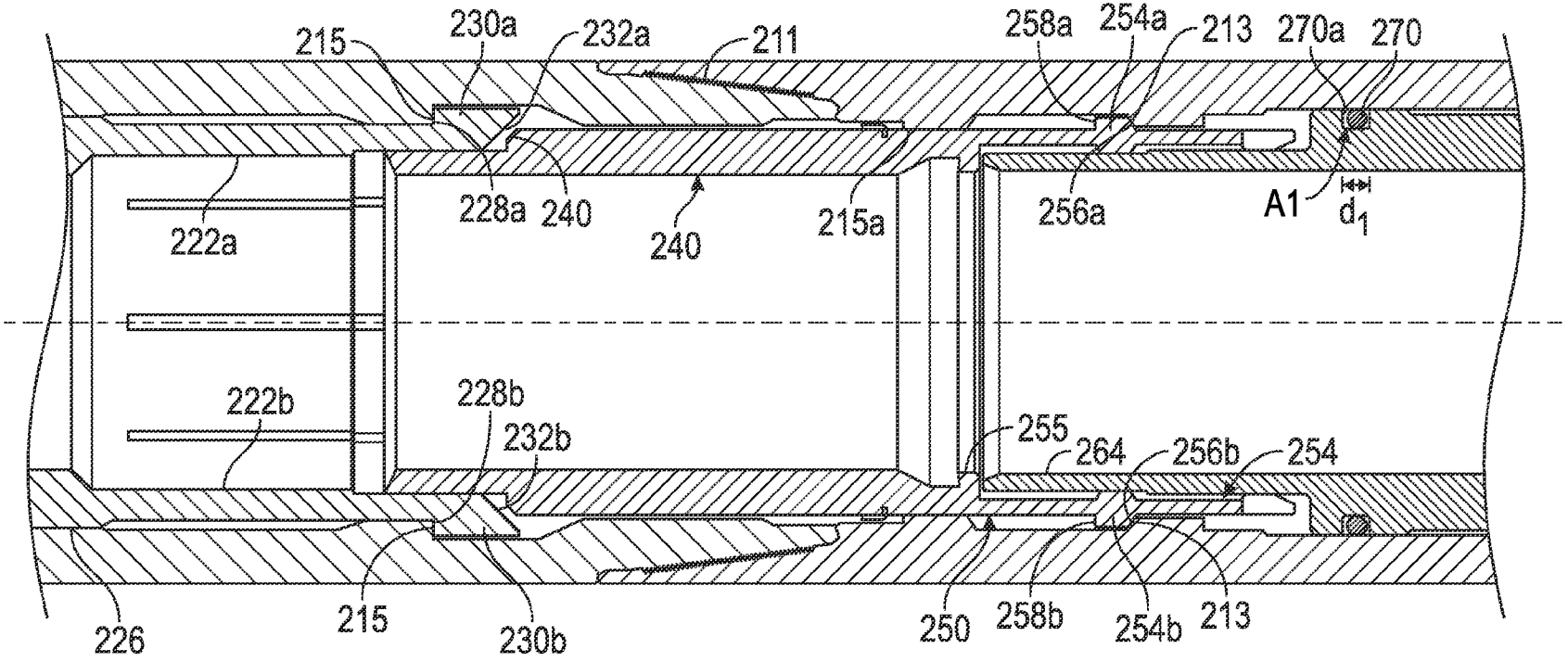
Figure 2C:
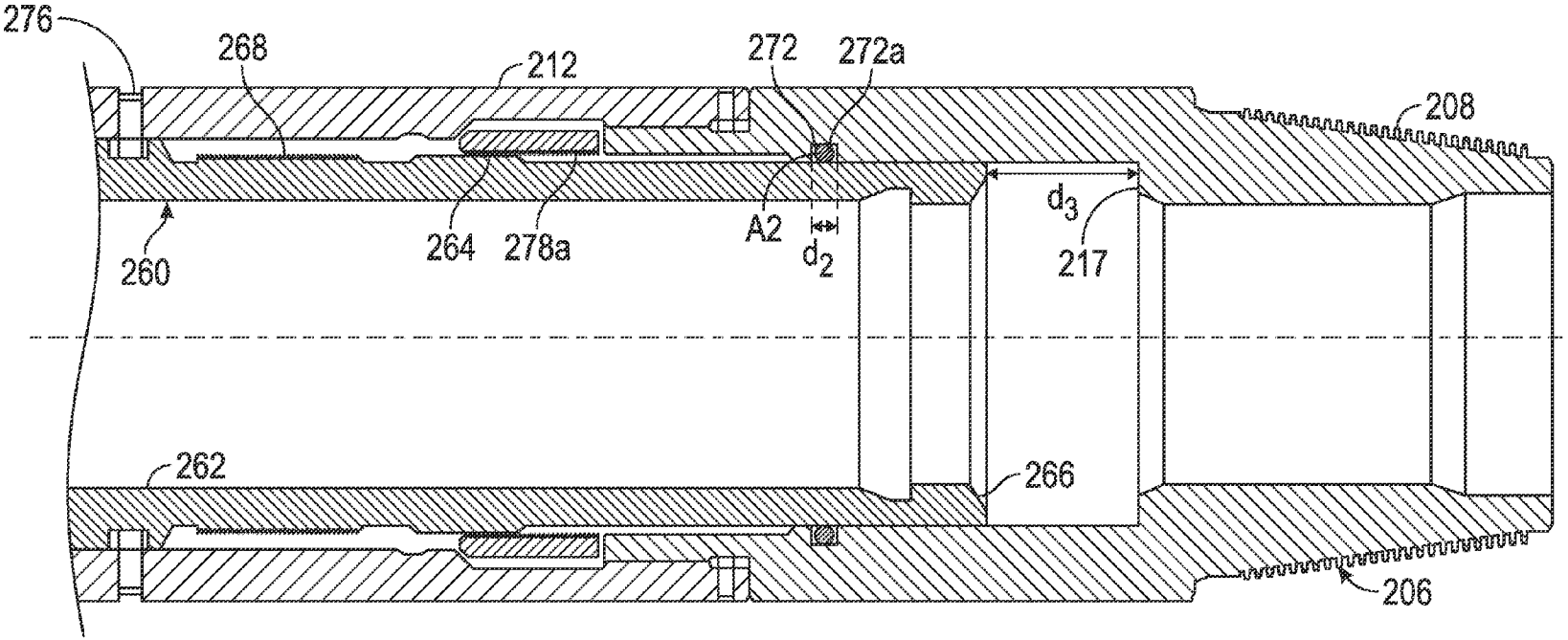

FIG. 2 shows a cross-section of a non-limiting embodiment of an expansion tool or device 200 in a run-in position that may be utilized in a suitable string deployed in a wellbore, including, but not limited to, the outer string 120 shown in FIG. 1. The expansion tool 200 includes a top sub 201 having a connection 202 for connection to a tubing uphole of the tool 200 and a bottom sub 206 having a connection 208 for connection to a tubing downhole of the expansion tool 200. The expansion tool 200 has a central bore 209 along a central axis 205. The expansion tool 200 further includes a housing 219 comprising an upper housing 210 axially connected to a lower housing 212 at a threaded connection 211. In a non-limiting embodiment, the expansion tool 200 includes a release collet 220, a release device or sleeve 240 and a lock device or sleeve 260 serially disposed inside the housing 219. The release collet 220 is attached at its upper end 221 to the top sub 201, such as by threads 223. The release collet 220 includes a tubular member 224 that includes a collet 222 having a number of collet fingers 222*a*, 222*b*, etc. Each collet finger has a profiled end. For example, finger 222*a* has a profiled end 230*a*, finger 222*b* has a profiled end 230*b*, etc. In the run-in position of the expansion tool 200 shown in FIG. 2, the end 230*a* of collet finger 222*a* is shown to include: a lock end or lock face 228*a* that abuts against or is enclosed by a lock profile 215 along an inner surface of the upper housing 210; and an outer surface or profile 232*a*. Similarly, end 230*b* of finger 222*b* includes a lock face 228*b* and an outer surface or profile 232*b*. The upper housing 210 may slide or move along a portion 226 of the longitudinal member 224, wherein a seal is formed between the upper housing 210 and the longitudinal member 224 of the release collet 220. In this position, the housing 219 is prevented from moving downhole (i.e., to the right in the configuration of FIG. 2) due to the locking of the ends 228*a*, 228*b* with the end 215 of the housing 210.

Still referring to FIG. 2, the release sleeve 240 has a longitudinal member 242 that has an upper end 244*a* below the finger ends 232*a*, 232*b* and a collet 250 at the other end 244*b*. The collet 250 includes a solid end 254 and a number of sections, each such section having a double-ended profile. In FIG. 2, the collect sections are shown as 254*a*, 254*b*, etc., wherein section 254*a* includes a face 256*a* that rests against or is proximate to an inner profile 213 of the lower housing 212 and a second face 258*a* uphole of the face 256*a*. When the release sleeve 240 is pushed downhole (to the right in FIG. 2), the collet section 254*a* will deflect radially and allow the face 256*a* to move to the right over the face 213 of the lower housing 212. In the run-in position this radial deflection is prevented by the sleeve 264. Other finger ends are similarly profiled. The release sleeve 240 is configured to move axially inside the lower housing 212 along an indented section 215*a* of the lower housing 212. The expansion tool 200 in the position shown in FIG. 2 is in the run-in position, i.e., the tool is ready to be conveyed into the wellbore. In the run-in position, the release sleeve 240 is prevented from moving to the right as the face 256*a* of the end 254*a* and end 256*b* of the end 254*b* are against or supported by the face 213 of the lower housing 212, which prevents movement of the release sleeve 240 to the right. The release sleeve 240 is prevented from moving uphole (to the left in FIG. 2) because the profile 232*a*, 232*b*, etc. of the finger 230*a*, 230*b*, etc. prevent the profile 249 of the release sleeve 240 to move past the fingers 230*a*, 230*b*. Thus, in the run-in position, the release sleeve 240 remains between the release collet 220 and the lock device 260.

Still referring to FIG. 2, the lock device 260 includes a tubular member 262 that has an upper section 264 inside the collet section 255 of the release sleeve and can slide over the collet fingers 254*a*, 254*b*, etc. The lock device 260 has an upper seal section 270 formed by a seal, such as o-ring 272*a*, between the member 262 and the lower housing 212 and a lower seal section 272 formed by a seal, such as o-ring 272*b*, between the member 262 and the lower housing 212. In one aspect, the area A1 of the seal section 270 is greater than the area A2 of the seal section 272. In one aspect, the area A1 may be defined by the diameter d1 of the seal 272*a* and the area A2 may be defined by the diameter d2 of the seal 272*b*. In one aspect, the difference between the areas A1 and A2 is such that when a fluid pressure above a selected amount or threshold is applied to inside the lock device 260, the member 262 and thus lock device 260 will move downhole (to the right). Until the selected pressure is applied to the lock device, a shear pin 276 prevents movement of the member 262, and thus keeps the lock device 260 from moving or activating, inside the housings 219. Wickers 278 on a lock ring 288 and wickers 264 on the lock sleeve 260 may be provided, as shown in FIG. 2, to prevent movement of the lock device 260 to the left (uphole). Also, solid end 254 of the release sleeve 240 prevents movement of the lock device 260 uphole (to the left). In this position, lock device 260 remains between the release sleeve 240 and at a distance d3 from the end 217 of the lower housing 212. The distance d3 between the end 266 of the lock sleeve and the end 217 of the lower housing 212 defines the travel of the lock device 260, when the shear pin 276 is sheared as described below in reference to FIG. 4. Wickers 268 on the lock ring 288 are provided to lock with the wickers 278 on the lower housing 212 to prevent movement of the lock device 260 to the left, once the lock device 260 has moved to the right as described in more detail below in reference to FIG. 3.

Figure 3A:
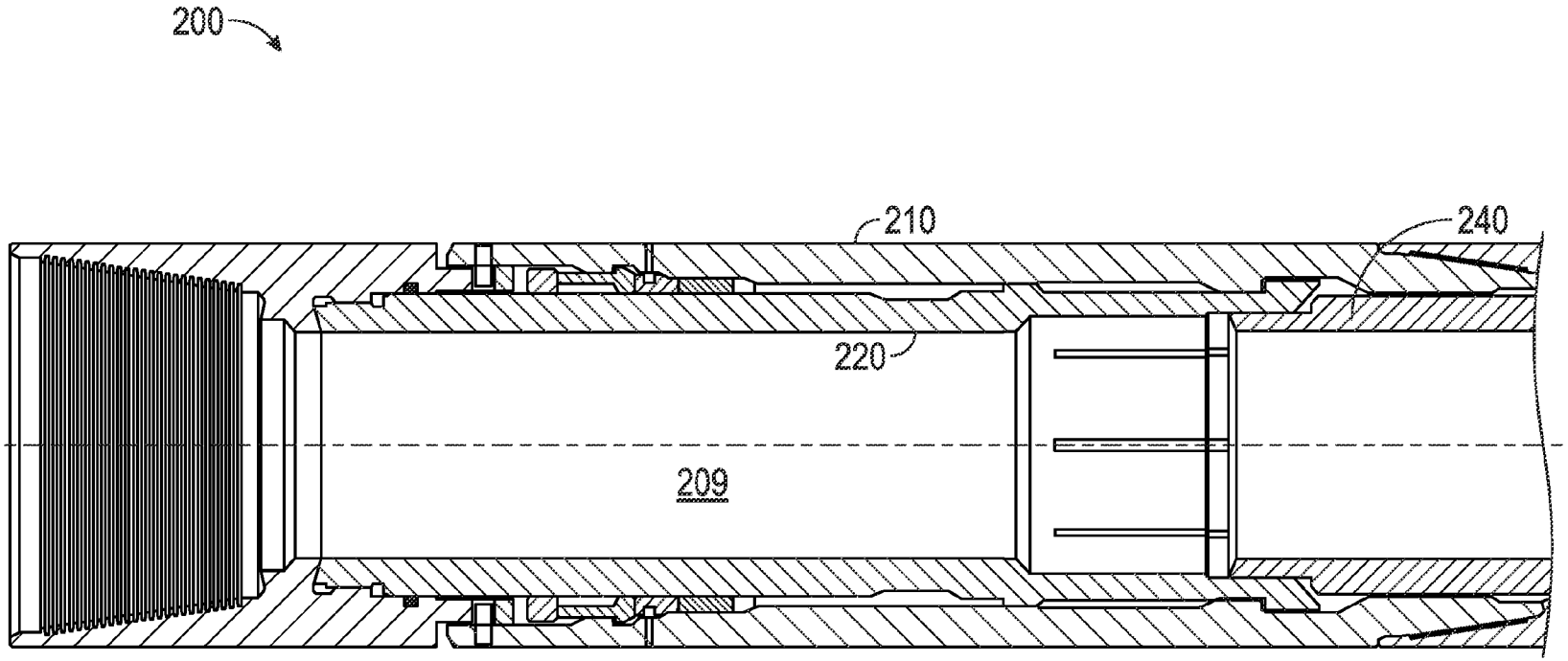
FIG. 3 shows the cross-section of the expansion tool of FIG. 2 in an armed position after the string has been deployed in the wellbore.
Figure 3B:
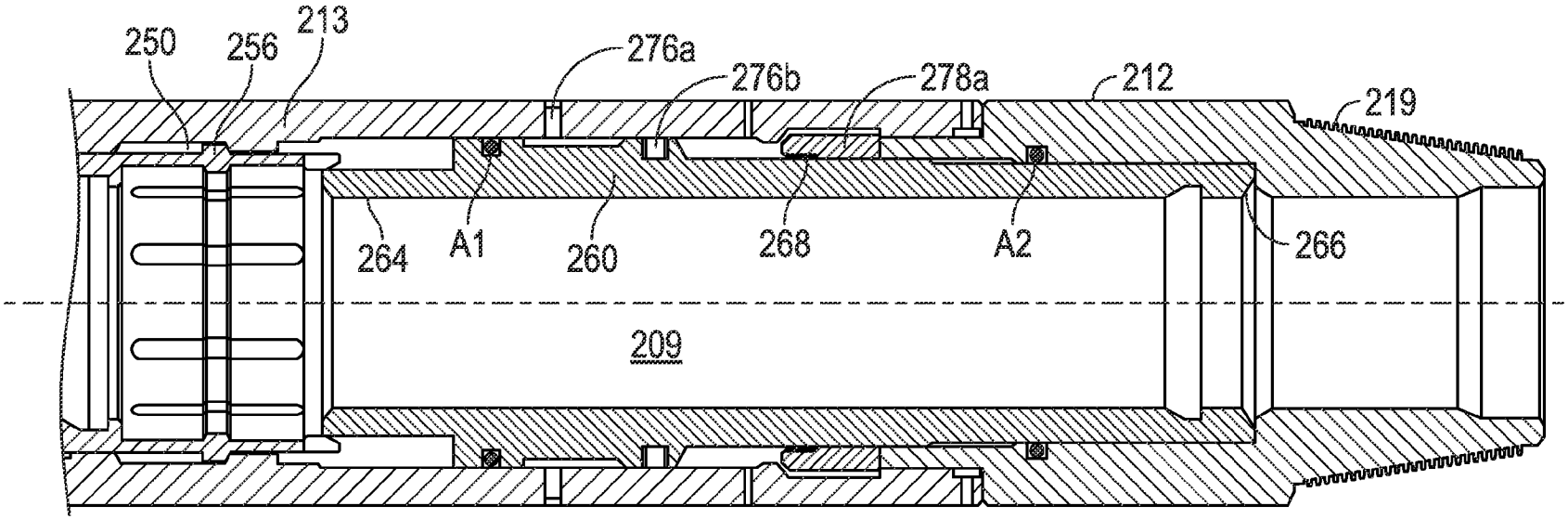

In operation, the expansion tool 200 is placed between two tubular members in a string, such as string 120, shown in FIG. 1. The string 120 is then deployed into the well. Referring now to FIG. 3, the pressure inside the string 120 and thus inside the passage 209 is raised to a level sufficient to create a selected or desired pressure differential between the areas A1 and A2 to cause the lock sleeve 260 to move to the right and thus shear the shear pin 276. Shearing of the shear pin 276 (as shown by sheared portions 276*a* and 276*b*) causes the lock sleeve 260 to move to the right by the distance d3, causing the end 266 of the lock sleeve 260 to abut against the end 217 of the lower housing 212. Also, wickers 268 on the lock device 260 engage with the wickers 278 on the lower ring 288. The expansion tool 200, as shown in FIG. 3, is referred to be in the armed position and is ready to be moved into the final position, referred to herein as the "released position" or "deployed position," upon the application of a selected mechanical force to the release sleeve 240, as described below in reference to FIGS. 3 and 4.

Figure 4A:
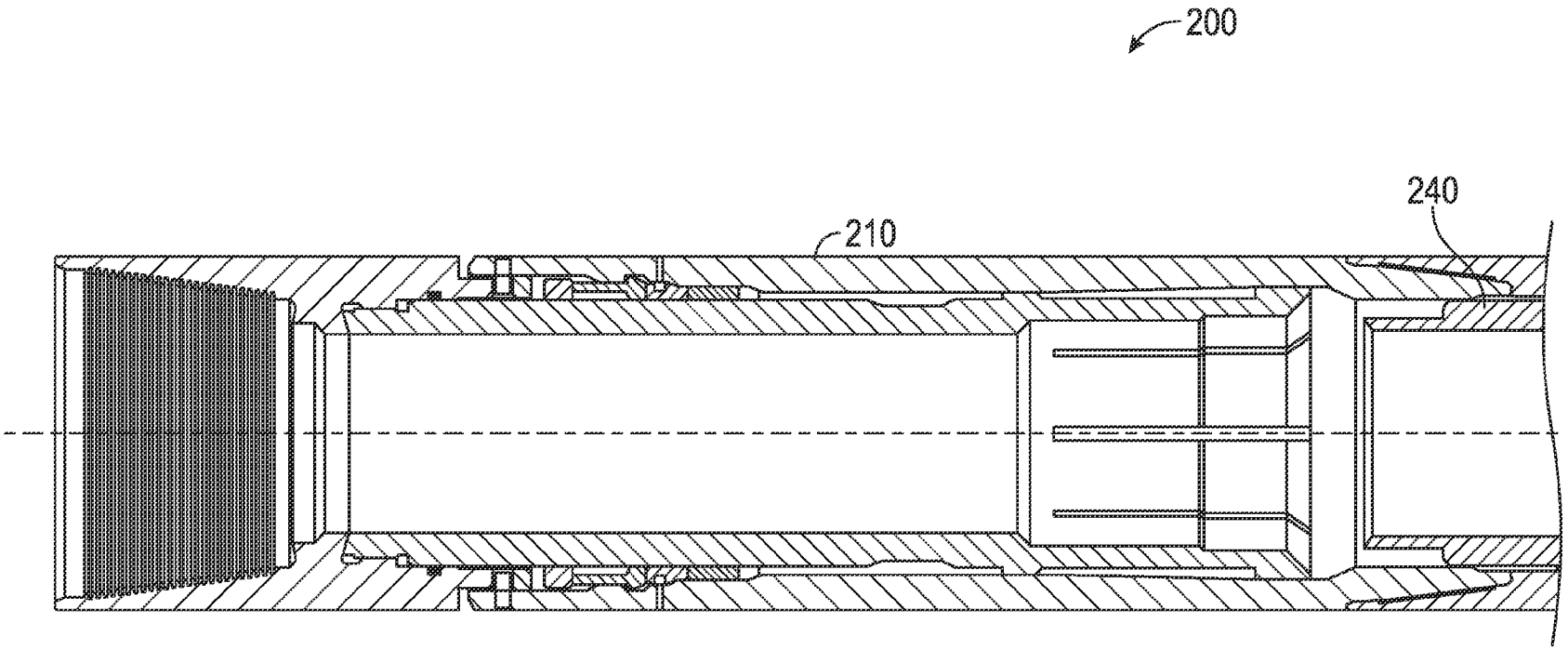
FIG. 4 shows the cross-section of the expansion tool of FIG. 3 in the released or deployed position.
Figure 4B:
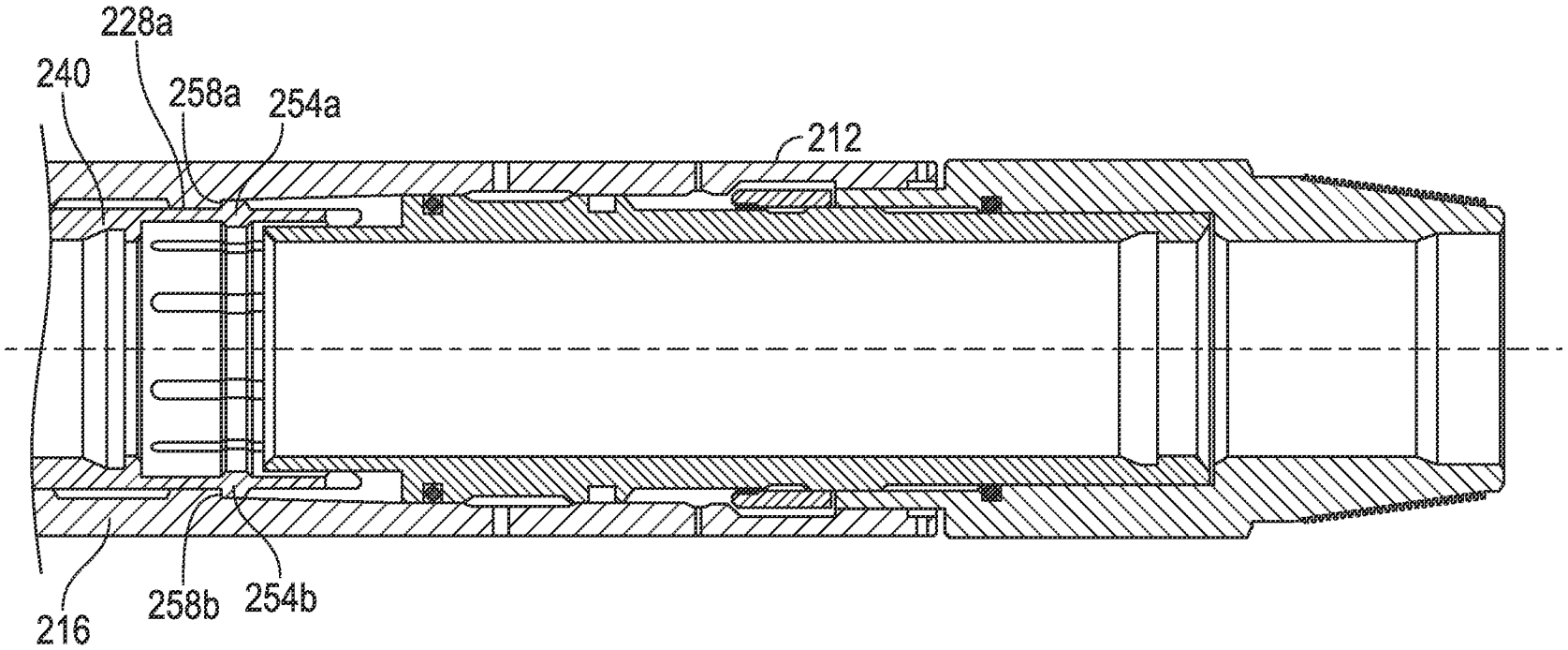

Referring now to FIGS. 3 and 4, to set the expansion tool 200 in the released or deployed position, a mechanical shifting tool (known in the art) is conveyed into the string 120 and engaged with the release sleeve 240. Pushing the shifting tool downward (to the right) causes the collet 250 to collapse, thereby causing the profile 256*a*, 256*b* of the release sleeve to disengage from the profile 213 of the lower housing 212, which allows the release sleeve 240 to move downhole (to the right), as shown in FIG. 4. The profiles 258*a*, 258*b*, etc. of the collet 250 pass over the profile 219 on the lower housing 212, which prevents the release sleeve 240 from moving uphole (to the left). In the released position, as shown in FIG. 4, the expansion tool 200 attains the deployed or expanded position.

Referring now to FIGS. 1 and 4, the string 120 containing one or more expansion tools, such as expansion tools 195*a*-195*n*, is deployed into the wellbore 101. The expansion tools 190*a*-190*n* are then placed in their respective released positions, as described above in reference to FIGS. 3 and 4. The wellbore 101 at this stage is at the formation temperature, which causes the expansion tools 195*a*-195*n* to achieve their expanded positions. The packers 124*a*-124*n* are then set either one at a time or all at the same time, causing the outer string 120 to anchor into the casing 104. During a treatment operation, such as fracing, the fluid supplied is at a temperature lower than the temperature of the wellbore, which may cause the string 120 to contract. As the string 120 contracts, the expansion tools 195*a*-195*n* contract correspondingly. In the particular embodiment of the expansion joint 200, contraction of the string 120 will cause the top sub 201 and the bottom sub 206 to contract, which will cause the housings 219 to move to the left over the release collet 220 and the release sleeve 260, thereby absorbing the shrinkage of the string 120. In one aspect, an expansion joint may be placed below (downhole) each packer at a suitable location, such as above the screens S1-Sn, as shown in FIG. 1. In such a configuration each zone Z1-Zn will include an expansion tool to operate when its corresponding zone is being treated.

Figure 5A:
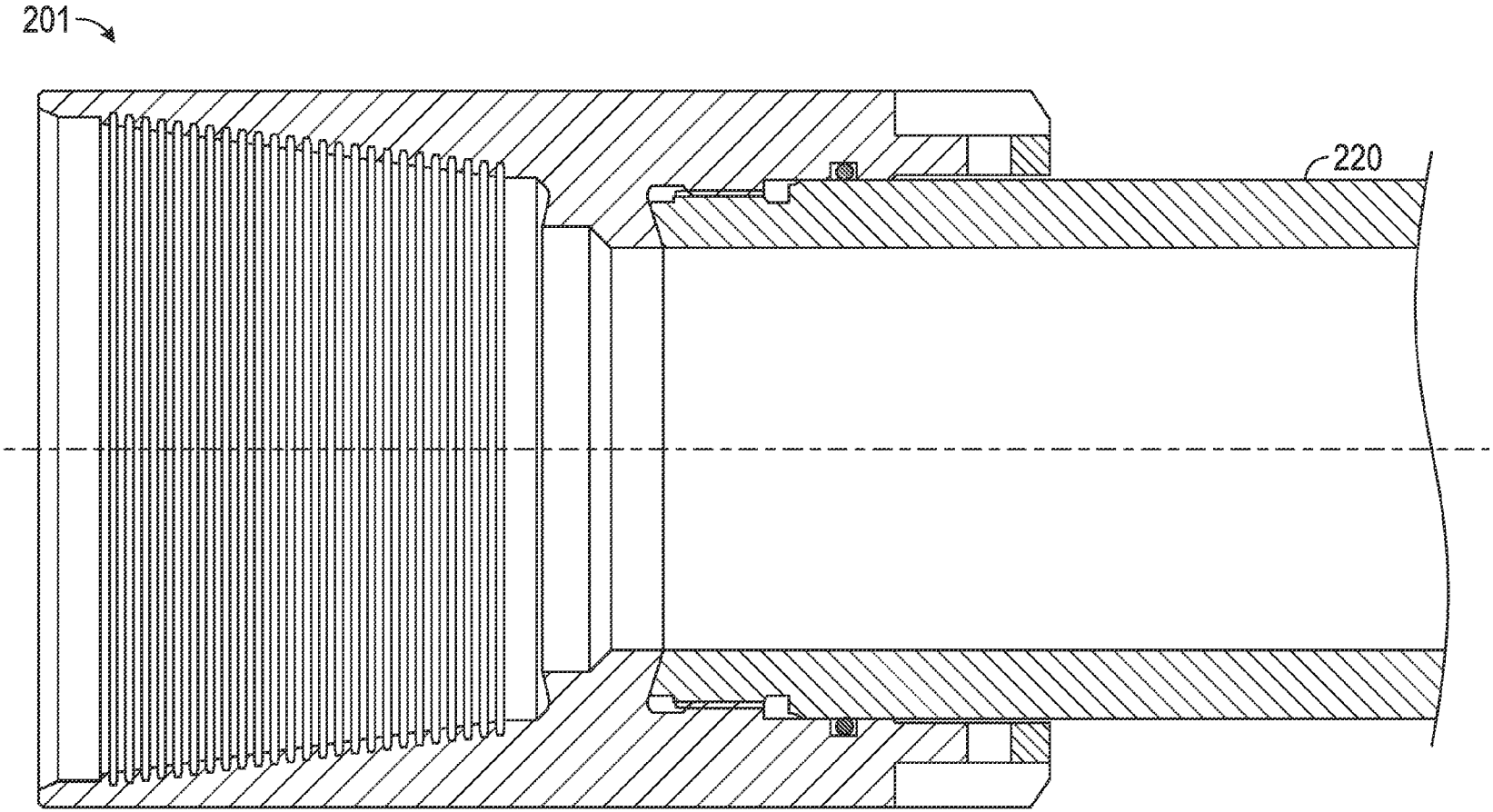
FIG. 5 shows a cross-section of a non-limiting embodiment of a disconnect device that may be incorporated into the expansion tool of FIG. 2.
Figure 5B:
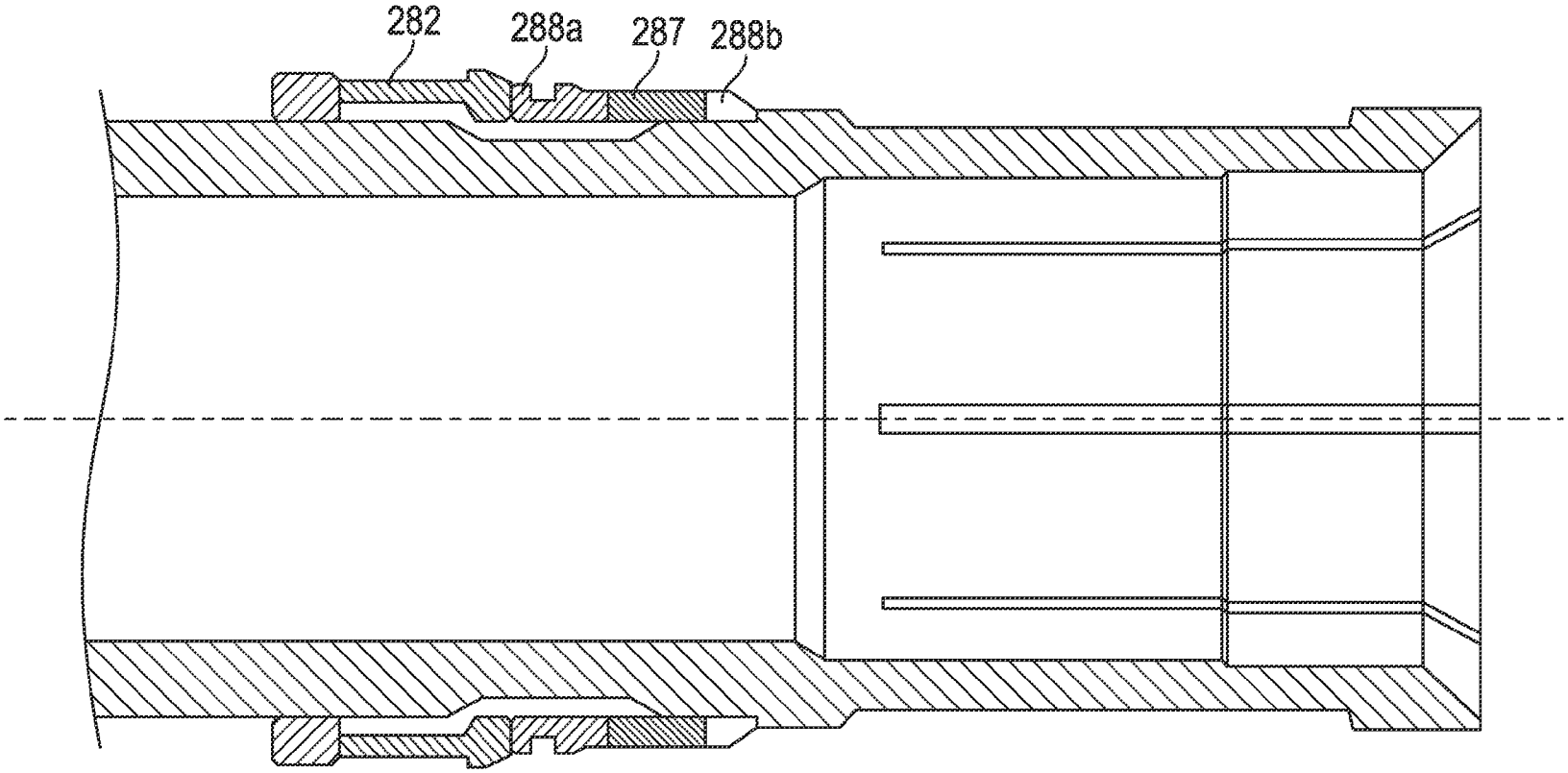

In another aspect, the expansion tool 200 may further include a disconnect or a disconnect tool that enables disconnecting the string 120 from the expansion tool 200, which expansion tools may be placed at suitable locations below the packers. Referring to FIG. 2, the expansion tool 200 is shown to include a non-limiting embodiment of a disconnect tool or disconnect device 280. In one non-limiting embodiment, the disconnect tool 280 includes a collet 282 that has a solid ring 281 on one end and collet fingers 282*a*, 282*b*, on the other end. A solid ring 289 with a shear pin 292 prevents the collet 282 from moving to the right. A seal 287 is provided between the solid ring 289 and another solid ring 288. The collet fingers 282*a*, 282*b* respectively include profiles 284*a*, 284*b* that abut against an inner profile 285 on the upper housing 210 that prevents the movement of the collet 280 to the left. To disconnect the string 120 from the expansion tool, a set down tool is conveyed into the string 120 and engaged with the top sub 201. When the set down tool is pulled uphole with a force above a selected load, the collet fingers 282*a*, 282*bb* disengage from the profile 285 of the upper housing 210, which breaks the shear pin 292, causing the release sleeve 220 to disengage from the profile 215 of the upper housing, thereby disconnecting the top sub 201 the release collet 220, collet 282, solid ring 288, seal 287 and solid ring 289, as shown in FIG. 5. The remaining components of the disconnect remain attached to the lower sub 206.

In aspects, the non-limiting embodiment of the expansion tool 200 described herein includes tubing to annulus seals that create a pressure barrier between the exterior and interior of the expansion tool 200. The expansion tool 200 geometry allows torque communication across the tool from the top sub 201 to the bottom sub 206. The expansion tool 200 also communicates axial tension and compression prior to activating the expansion tool 200 to the release or deployed position shown in FIG. 4. A suitable tool, such as shifting tool (known in the art), may be utilized to release the expansion tool 200, which allows it to stroke while maintaining seal integrity and absorbing axial changes in the expansion tool length due to thermal effects on its various components. A locking mechanism or device or member, such as the lock sleeve 260, prevents premature shift of the release sleeve 240. Once the expansion tool 200 has been located properly in the wellbore, the locking mechanism is activated, allowing the release sleeve 240 to be shifted mechanically when desired. As is well known in the art, many factors including internal/external fluid circulation, formation composition, depth, and geological conditions create a temperature cycle affecting the physical length of tools in the outer sting 120, an effect that is cumulative and increases over distances. Increased tensile/compressive forces acting upon rigid components can cause stress failures lacking a device to absorb these forces. The expansion joint 200 shares system burst and collapse pressure, allows torque as well as tensile "pull" and compression "push" communication through the expansion tool 200 from one end connection (top sub 201) to the other end connection (bottom sub 206) until unlocked then released in separate operations, which operation disengages collet fingers that can deflect out of a collet finger groove allowing stroke along a seal diameter. During run-in, the expansion tool 200 is locked and the collet fingers transfer tension while compression is applied from the top sub to the outer housing. Once the gravel pack assembly is downhole and located properly, the lock feature can be activated allowing the release sleeve to be shifted when ready. Packers are set and a gravel pack is performed, locking the expansion tool somewhat in place by packing the annular area around the expansion tool with a filter media. Temperature changes at this point would apply stresses to the string 120 and the expansion tool 200 axially. After the gravel packing, the release sleeve is shifted to release the collet fingers to allow axial forces to stroke the expansion tool to remove the accumulated effect over the length of the completion. The lock feature prevents accidental shifting of the release sleeve 240 during run-in and other operations. The lock feature can be actuated at surface without the need to run a shifting tool. Should assembly removal after expansion tool release be necessary, an optional snap ring in the assembly can allow the removal of lower components upon reaching the expansion joints maximum stroke, or the absence of the snap ring would allow a complete separation of the upper and lower expansion joint allowing future tools to snap into and seal within the remaining geometry. Additionally, the individual actuation of both the lock sleeve and the release sleeve may be initiated hydraulically, pneumatically, mechanically, via stored energy such as pressure chamber or energized spring, expanding/contracting material, motorized, or by any energy source. The locking mechanism which holds tension during run-in and possibly provides a "push" shoulder could be collet fingers, collected threads, locking dogs, or other geometry that provides a shoulder to apply tension against and/or push or compression.

The foregoing disclosure is directed to the certain exemplary embodiments and methods according to one or more non-limiting embodiments of the apparatus and methods described herein. Various modifications to such apparatus and methods will be apparent to those skilled in the art. It is intended that all such modifications within the scope of the appended claims be embraced by the foregoing disclosure. The words "comprising" and "comprises" as used in the claims are to be interpreted to mean "including, but not limited to". Also, the abstract is not to be used to limit the scope of the claims.

The invention claimed is:

1. An apparatus for use in a wellbore, comprising:

a string for deployment into the wellbore, the string including a packer and an expansion tool downhole of the packer;

wherein the expansion tool includes:

a housing;

a release device and a lock device inside the housing;

wherein the lock device includes a shear pin to prevent movement of the lock device and the lock device prevents shifting of the release device until the lock device is moved to an unlocked position by application of a first force to the lock device, wherein application of the first force shears the shear pin, the lock device is movable from a locked position to the unlocked position by application of a fluid pressure in the expansion tool, and the lock device includes two pressure areas that create a differential pressure when the fluid pressure is above a selected level sufficient to cause the lock device to move from the locked position to the unlocked position; and wherein the release device is movable to a released position by application of a second force after the lock device has been moved to the unlocked position; and wherein the housing is capable of moving after the release device has been moved to the released position to absorb at least one of contraction and expansion of the string.

2. The apparatus of claim 1 further comprising a device that prevents movement of the release device in a direction opposite from the direction of the movement of the lock device during run-in of the string in the wellbore.

3. The apparatus of claim 1, wherein the expansion tool further includes at least one seal between the lock device and the housing to provide a seal between inside of the expansion tool and the wellbore.

4. The apparatus of claim 1, wherein the lock device is movable to the unlocked position by one selected from the group consisting of. (i) hydraulically; (ii) pneumatically; (iii) mechanically; (iv) a stored energy selected from a group consisting of a pressure chamber and an energized spring; and an expanding/contracting material; (v) a motorized device; and (vi) and an energy source.

5. The apparatus of claim 1, wherein the release device is movable by a mechanical force.

6. The apparatus of claim 1, wherein the lock device is prevented from movement uphole by a ratchet mechanism.

7. The apparatus of claim 1, wherein in a run-in position, the release device is held in position by a collet at a first end of the release device and by the lock device at a second end of the release device.

8. The apparatus of claim 1, wherein the expansion tool further includes a disconnect device uphole of the release device.

9. The apparatus of claim 1, wherein the lock device is configured to be moved to the unlocked position by application of a fluid pressure exceeding a threshold to an inside of the expansion tool and the release device is configured to be moved to the release position by application of a mechanical force to the release device.

10. The apparatus of claim 1, wherein the lock device includes a component selected from a group consisting of: collet fingers; colleted threads; locking dogs; and a snap ring.

11. The apparatus of claim 1, wherein the lock device includes a first pressure area greater than a second pressure area and wherein application of a selected fluid pressure inside the lock device creates a differential pressure due to the difference in the first area and the second area to cause the lock device to move from a first lock position to a second lock position to enable shifting of the release device.

12. A method of performing a treatment operation in a wellbore, the method comprising:

placing a string in the wellbore, the string including a packer and an expansion device downhole of the packer, wherein the expansion device includes a release device held in position by a lock device during run-in of the string into the wellbore, wherein the lock device includes a shear pin to prevent movement of the lock device;

locating the packer at desired location;

unlocking the lock device when the expansion tool is in the wellbore by applying a first force to shear the shear pin of the lock device, the lock device is movable from a locked position to an unlocked position by application of a fluid pressure in the expansion tool, and the lock device includes two pressure areas that create a differential pressure when the fluid pressure is above a selected level sufficient to cause the lock device to move from the locked position to the unlocked position;

setting the packer in the wellbore; releasing the release device by a tool conveyed from a surface location into the wellbore so as to enable the expansion tool to absorb shrinkage of the string during the treatment operation; and performing the treatment operation that will cause the string to contract.

13. The method of claim 12, wherein during the run-in the release device is held in position by a collet at a first end of the release device and by the lock device at a second end of the release device.

14. The method of claim 12, wherein the release device is locked in position during the run-in by a collet at one end of the release device and the lock device at another end of the release device.

15. The method of claim 12, wherein the expansion tool further includes a disconnect device uphole of the release device.

16. The method of claim 15, wherein the disconnect device comprises a collet.

17. The method of claim 12, wherein the release device is configured to be moved to the release position by application of a mechanical force to the release device.

* * * * *